US009958813B2

(12) United States Patent
Iwamoto

(10) Patent No.: US 9,958,813 B2
(45) Date of Patent: May 1, 2018

(54) IMAGE FORMING APPARATUS

(71) Applicant: KYOCERA Document Solutions Inc., Osaka (JP)

(72) Inventor: Naoki Iwamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/644,086

(22) Filed: Jul. 7, 2017

(65) Prior Publication Data

US 2018/0017905 A1 Jan. 18, 2018

(30) Foreign Application Priority Data

Jul. 13, 2016 (JP) ..... 2016-138160
Jun. 30, 2017 (JP) ..... 2017-128350

(51) Int. Cl.
*G03G 15/16* (2006.01)

(52) U.S. Cl.
CPC ..... *G03G 15/1665* (2013.01); *G03G 15/161* (2013.01)

(58) Field of Classification Search
CPC ..... G03G 15/1665; G03G 15/161
USPC ..... 399/101
See application file for complete search history.

(56) References Cited

U.S. PATENT DOCUMENTS

2013/0188981 A1* 7/2013 Horiguchi ..... G03G 15/1605 399/88
2013/0287421 A1* 10/2013 Makino ..... G03G 15/1675 399/66
2014/0321874 A1* 10/2014 Sugiura ..... G03G 21/0035 399/71
2015/0338791 A1* 11/2015 Matsushita ..... G03G 15/1615 399/66

FOREIGN PATENT DOCUMENTS

JP 2004-062086 A 2/2004
JP 2011133581 A * 7/2011

* cited by examiner

*Primary Examiner* — Susan Lee
(74) *Attorney, Agent, or Firm* — Studebaker & Brackett PC

(57) ABSTRACT

An image forming apparatus includes a transferring belt, photosensitive drums, primary transferring parts, a transfer voltage applying part, a resistance value measuring part, a cleaning device, a pre-brush, a pre-brush current detecting part and a transfer voltage correcting part. The pre-brush applies a cleaning charge voltage to the remained toner at an upstream side from the cleaning device in the rotation direction of the transferring belt. The transfer voltage correcting part, by a subject resistance value of the primary transferring part measured by the resistance value measuring part, corrects a transfer voltage of the primary transferring part. As a measurement condition, if a change quantity of the pre-brush current from the last transfer voltage correction is equal to or more than a predetermined change threshold, the resistance value measuring part executes measurement of the subject resistance value and the transfer voltage correcting part executes correction of the transfer voltage.

12 Claims, 6 Drawing Sheets

IMAGE FORMING APPARATUS

INCORPORATION BY REFERENCE

This application is based on and claims the benefit of priority from Japanese Patent applications No. 2016-138160 filed on Jul. 13, 2016, and No. 2017-128350 filed on Jun. 30, 2017, the entire contents of which are incorporated herein by reference.

BACKGROUND

The present disclosure relates to an image forming apparatus including a plurality of photosensitive drums along a transferring belt.

An image forming apparatus of a photographic manner includes a plurality of photosensitive drums along a transferring belt and includes a plurality of primary transferring parts with respect to the plurality of photosensitive drums, respectively. A surface of each photosensitive drum is electrically charged and exposed according to image data, and thereby, an electrostatic latent image is formed on the surface of each photosensitive drum. Further, a toner of each color is adhered to the electrostatic latent image, and accordingly, the electrostatic latent image is developed, and thereby, a toner image of each color is formed. The toner image of each color formed on each photosensitive drum is primarily transferred to the transferring belt by each primary transferring part to which a voltage of a reverse polarity of the toner has been applied, and thereby a full color toner image is formed.

In order to supply an optimal transfer current to each primary transferring part, it is necessary to apply a transfer voltage according to a resistance of a transferring member, such as a roller or a belt, constituting each primary transferring part. However, the transferring member, such as the roller or the belt, constituting each primary transferring part may be degraded due to a temperature change or a change with an elapse of time, and accordingly, a resistance value may be changed. Therefore, it is necessary to correct the transfer voltage in accordance with a change of the resistance value of each primary transferring part.

For example, an image forming apparatus includes: an image carrier having a surface on which a developer image is formed; an intermediate transferring body to which the developer image is transferred; and secondary transferring means transferring the developer image from the intermediate transferring body to a recording medium by applying a secondary transferring bias to a secondary transferring part. A volume resistance rate of the intermediate transferring body has a temperature dependency. Moreover, the image forming apparatus has temperature sensing means sensing a temperature of the intermediate transferring body. In addition, according to a temperature sensing result by the temperature sensing means, impedance (resistance value) of the secondary transferring part is sensed, and then, an applied voltage of the secondary transferring bias is controlled.

However, because detection of the resistance value of the transferring member takes time, a construction including a plurality of primary transferring parts for respective toner colors, such as a color printer, takes further time in order to measure the resistance value of each primary transferring part. In addition, if the transfer voltage is corrected in accordance with the change of the resistance value of each primary transferring part, furthermore time is taken. Thus, productivity of printing process utilizing the plurality of primary transferring parts may be impeded.

SUMMARY

In accordance with the present disclosure, an image forming apparatus includes an annular transferring belt rotating in a predetermined direction, a plurality of photosensitive drums, a plurality of primary transferring parts, a transfer voltage applying part, a resistance value measuring part, a cleaning device, a pre-brush, a pre-brush current detecting part and a transfer voltage correcting part. The plurality of photosensitive drums are disposed along a rotation direction of the transferring belt. The plurality of primary transferring parts transfer images respectively formed on the plurality of photosensitive drums to the transferring belt. The transfer voltage applying part applies respectively voltages to the plurality of primary transferring parts. The resistance value measuring part measures a subject resistance value of the primary transferring part. The cleaning device collects a remained toner on the transferring belt. The pre-brush applies a cleaning charge voltage of the same polarity as the remained toner to the remained toner on the transferring belt at an upstream side from the cleaning device in the rotation direction of the transferring belt. The pre-brush current detecting part detects a pre-brush current flowing through the pre-brush. The transfer voltage correcting part, on the basis of a subject resistance value of the primary transferring part measured by the resistance value measuring part, corrects a transfer voltage with respect to the primary transferring part. A case where a change quantity of the pre-brush current detected by the pre-brush current detecting part from the last transfer voltage correction by the transfer voltage correcting part is equal to or more than a predetermined change threshold is set as a measurement condition. If the measurement condition is satisfied, the resistance value measuring part executes resistance value measurement measuring the subject resistance value of the primary transferring part and the transfer voltage correcting part executes the transfer voltage correction correcting the transfer voltage of the primary transferring part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
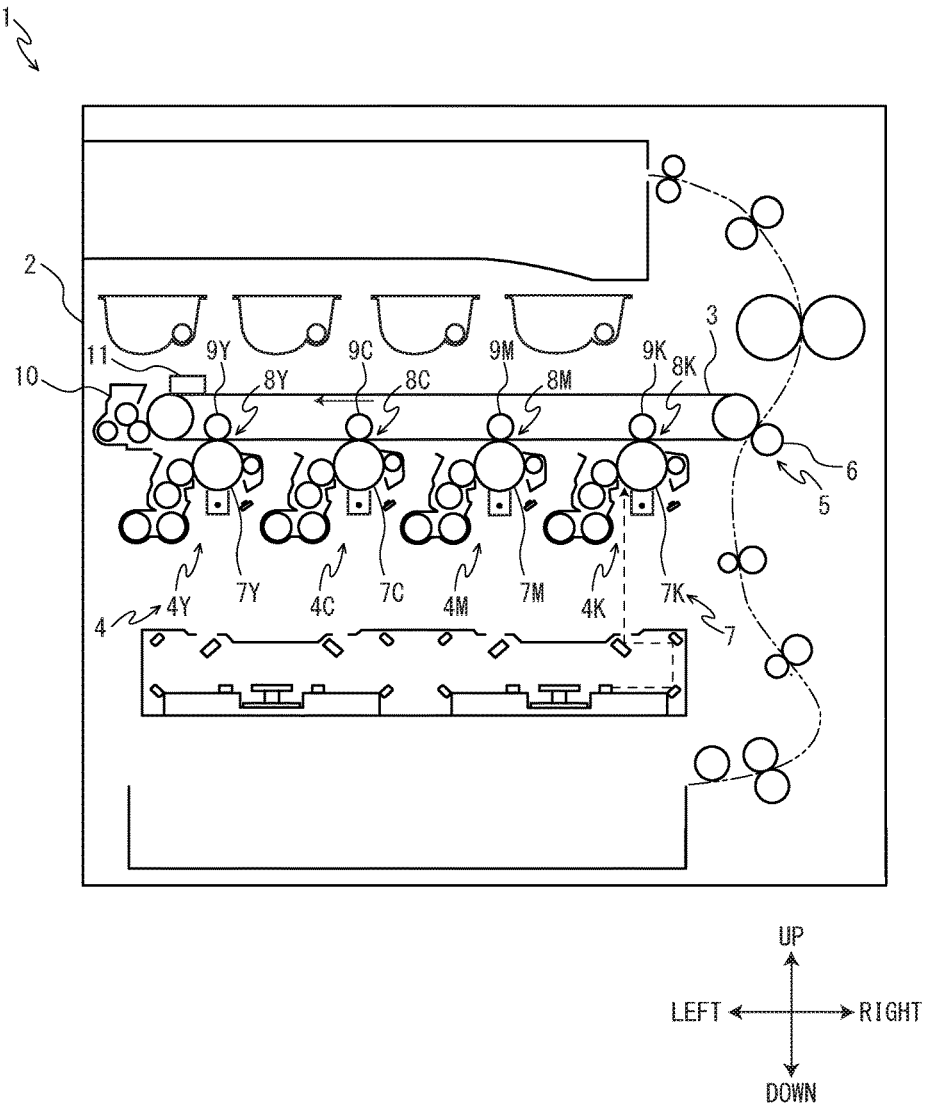
FIG. 1 is a sectional view showing a color printer according to an embodiment of the present disclosure.

First, an entire configuration of a color printer 1 (an image forming apparatus) according to an embodiment of the present disclosure will be described with reference to FIG. 1. Hereinafter, for convenience of description, it will be described so that the front side of the color printer is positioned at the near side on a paper sheet of FIG. 1.

The color printer 1 includes a roughly box-formed printer body 2 and, at a center part of the printer body 2, an annular intermediate transferring belt 3 (a transferring belt) rotating in a predetermined direction is windingly stretched among a plurality of rollers. At a lower side of the intermediate transferring belt 3, four image forming parts 4 (4Y, 4C, 4M and 4K) are provided for respective toner colors (e.g. four colors of yellow, cyan, magenta, black). The respective image forming parts 4 correspond to the respective colors of yellow (Y), cyan (C), magenta (M) and black (K) in sequential order from an upstream side in a rotation direction of the intermediate transferring belt 3 (a left side in the embodiment). Hereinafter, except a case of a description with specifying colors, reference codes "Y", "C", "M" and "K" are omitted with respect to the respective components corresponding to the toner colors. At a right end of the intermediate transferring belt 3, a secondary transferring part 5 is provided and the secondary transferring part 5 is composed of a part of a right end side of the intermediate transferring belt 3 and a secondary transferring roller 6.

In each image forming part 4, a photosensitive drum 7 is rotatably provided, in other words, four photosensitive drums 7 (7Y, 7C, 7M and 7K) are disposed along the rotation direction of the intermediate transferring belt 3. Around the photosensitive drum 7, a primary transferring part 8 is disposed, in other words, four primary transferring parts 8 (8Y, 8C, 8M and 8K) are respectively provided with respect to the respective four photosensitive drums 7 (7Y, 7C, 7M and 7K). Each primary transferring part 8 is composed of a part of the intermediate transferring belt 3 and a primary transferring roller 9. The primary transferring roller 9 is disposed to face to each photosensitive drum 7 across the intermediate transferring belt 3. In other words, four primary transferring rollers 9 (9Y, 9C, 9M and 9K) of the four primary transferring parts 8 (8Y, 8C, 8M and 8K) are disposed to face to the respective four photosensitive drums 7 (7Y, 7C, 7M and 7K).

Moreover, at a left end of the intermediate transferring belt 3, a cleaning device 10 cleaning the intermediate transferring belt 3 is provided and, at an upstream side from the cleaning device 10 in the rotation direction of the intermediate belt 3, a pre-brush 11 is provided.

Figure 2:
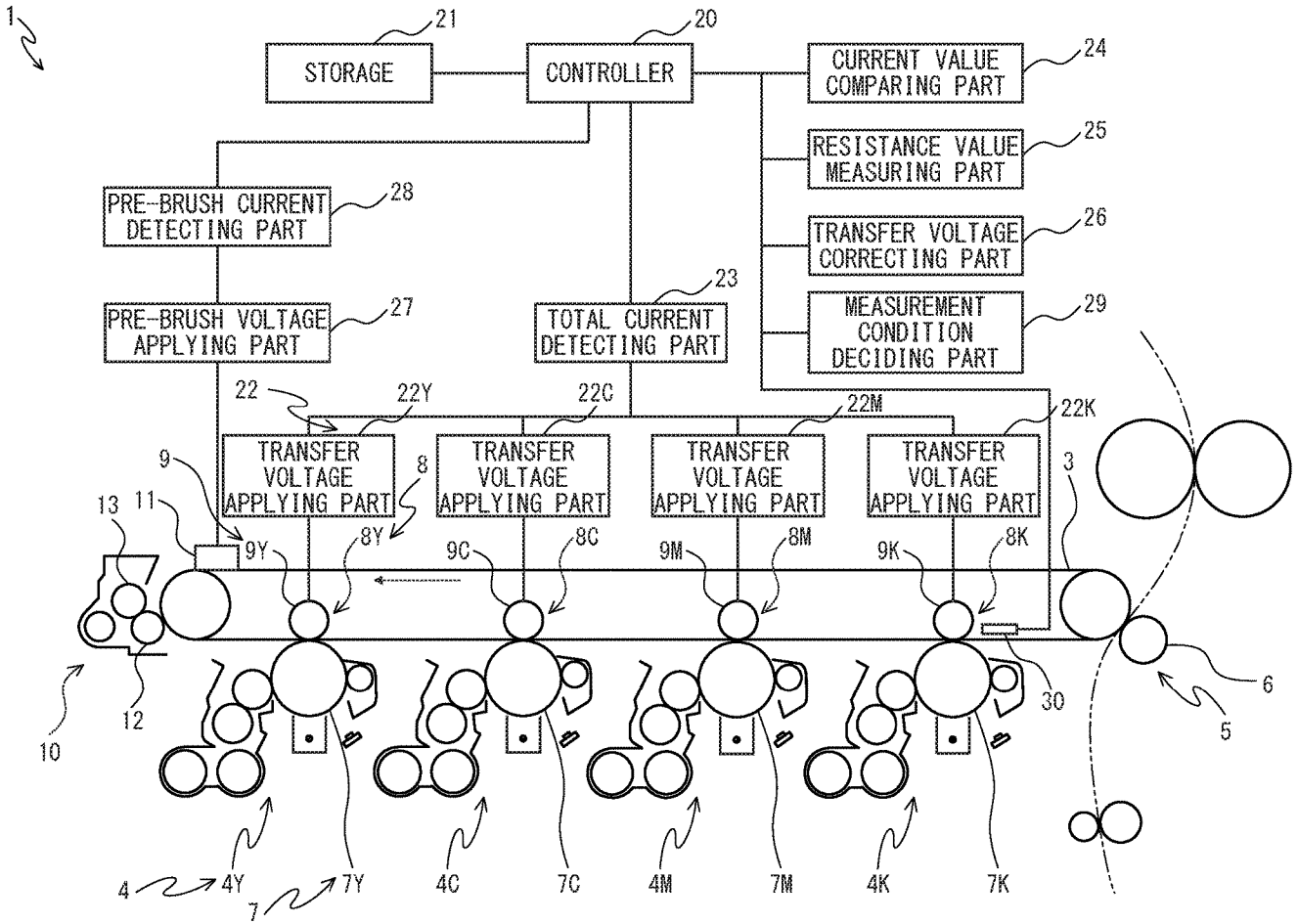
FIG. 2 is a schematic view showing an electrical configuration in the color printer according to the embodiment of the present disclosure.

The cleaning device 10 consists of, for example, as shown in FIG. 2, a cleaning roller 12, such as a rotating brush, and a collecting roller 13. The cleaning roller 12 is rotated while coming into contact with the intermediate transferring belt 3 to catch the remained toner on the intermediate transferring belt 3. The collecting roller 13 collects the remained toner caught by the cleaning roller 12. To the collecting roller 13, a voltage of a reverse polarity (e.g. a negative polarity) of a polarity (e.g. a positive polarity) of the remained toner is applied.

The pre-brush 11 comes into contact with the intermediate transferring belt 3 to electrically charge and float the remained toner on the intermediate transferring belt 3. To the pre-brush 11, a voltage of the same polarity as the polarity (e.g. the positive polarity) of the remained toner is applied.

In an image forming process of the color printer 1, an image of each color is formed by each image forming part 4. At this time, in each image forming part 4, first, the photosensitive drum 7 is electrically charged by a charger (not shown). Afterwards, on the basis of image data inputted from an external computer (not shown) or the like, the photosensitive drum 7 is exposed by an exposure device (not shown), and thereby, a electrostatic latent image is formed on the photosensitive drum 7. The electrostatic latent image on the photosensitive drum 7 is developed for a toner image of each color by a development device (not shown). The toner image on the photosensitive drum 7 is primarily transferred to a surface of the intermediate transferring belt 3 by the primary transferring part 8. The above-described operation is repeated by the four image forming parts 4 sequentially, and thereby, a toner image of full color (hereinafter, referred to as a color toner image) is formed on the intermediate transferring belt 3.

In addition, in the image forming process of the color printer 1, the color toner image is supplied to the secondary transferring part 5 by way of rotation of the intermediate transferring belt 3. In the secondary transferring part 5, a sheet is supplied from a sheet feeding cartridge (not shown) in accordance with a timing together with the color toner image and the color toner image on the intermediate transferring belt 3 is secondarily transferred to the sheet. Further, in the color printer 1, the color toner image on the sheet is fixed by a fixing device (not shown) and the sheet having the fixed color toner image is ejected to an ejected sheet (not shown). Incidentally, the remained toner on the intermediate transferring belt 3 is cleaned and collected by the pre-brush 11 and the cleaning device 10.

Next, an electrical configuration of the color printer 1 will be described with reference to FIG. 2. The color printer 1 includes a controller 20, a storage 21, four transfer voltage applying parts 22 (22Y, 22C, 22M and 22K), a total current detecting part 23, a current value comparing part 24, a resistance value measuring part 25, a transfer voltage correcting part 26, a pre-brush voltage applying part 27, a pre-brush current detecting part 28, a measurement condition deciding part 29, and a temperature sensing part 30.

Figure 3:
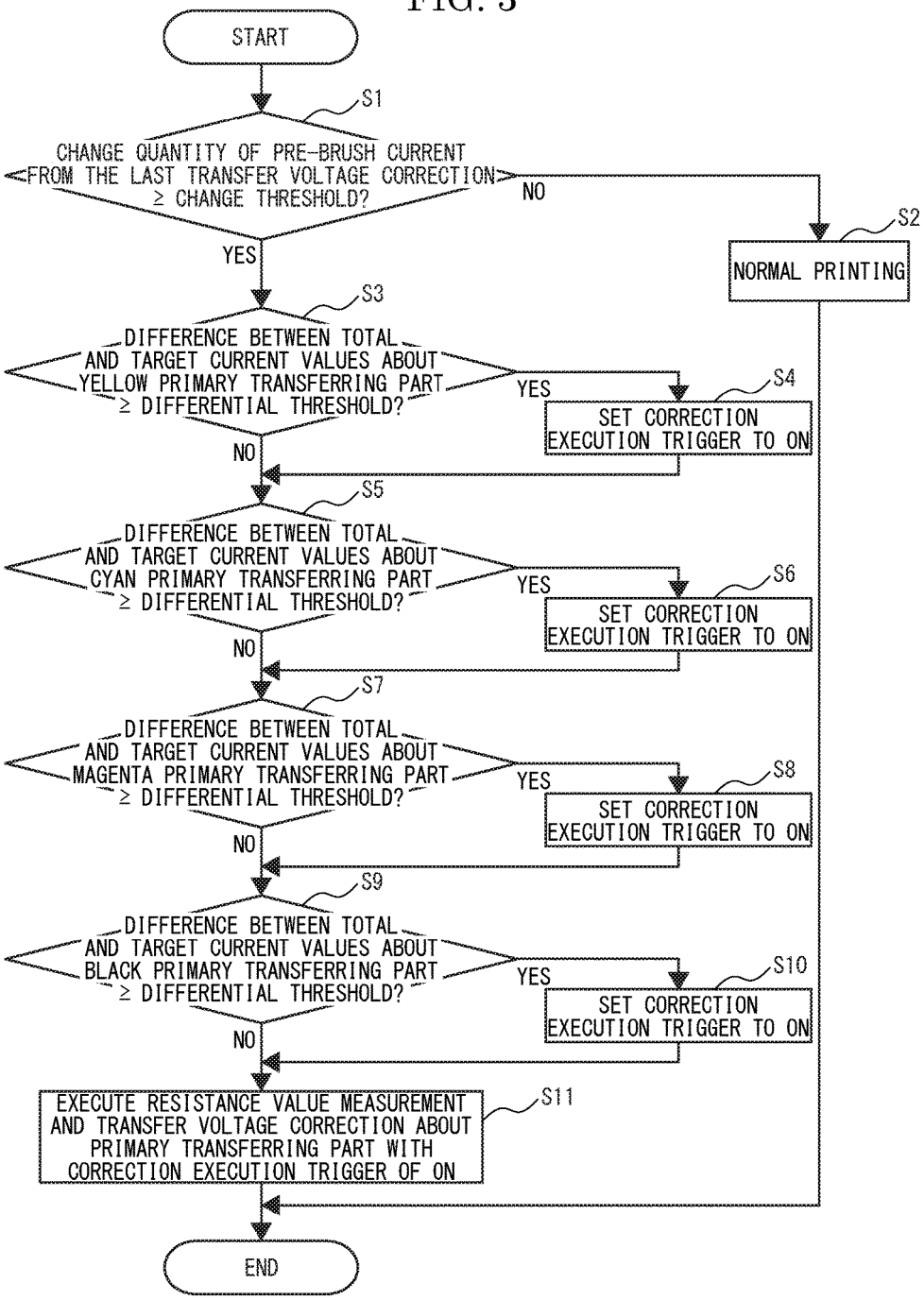
FIG. 3 is a flowchart showing operations of measurement condition decision in the color printer according to the embodiment of the present disclosure, and total current detection, resistance value measurement and transfer voltage correction of each primary transferring part of the color printer.
Figure 4:
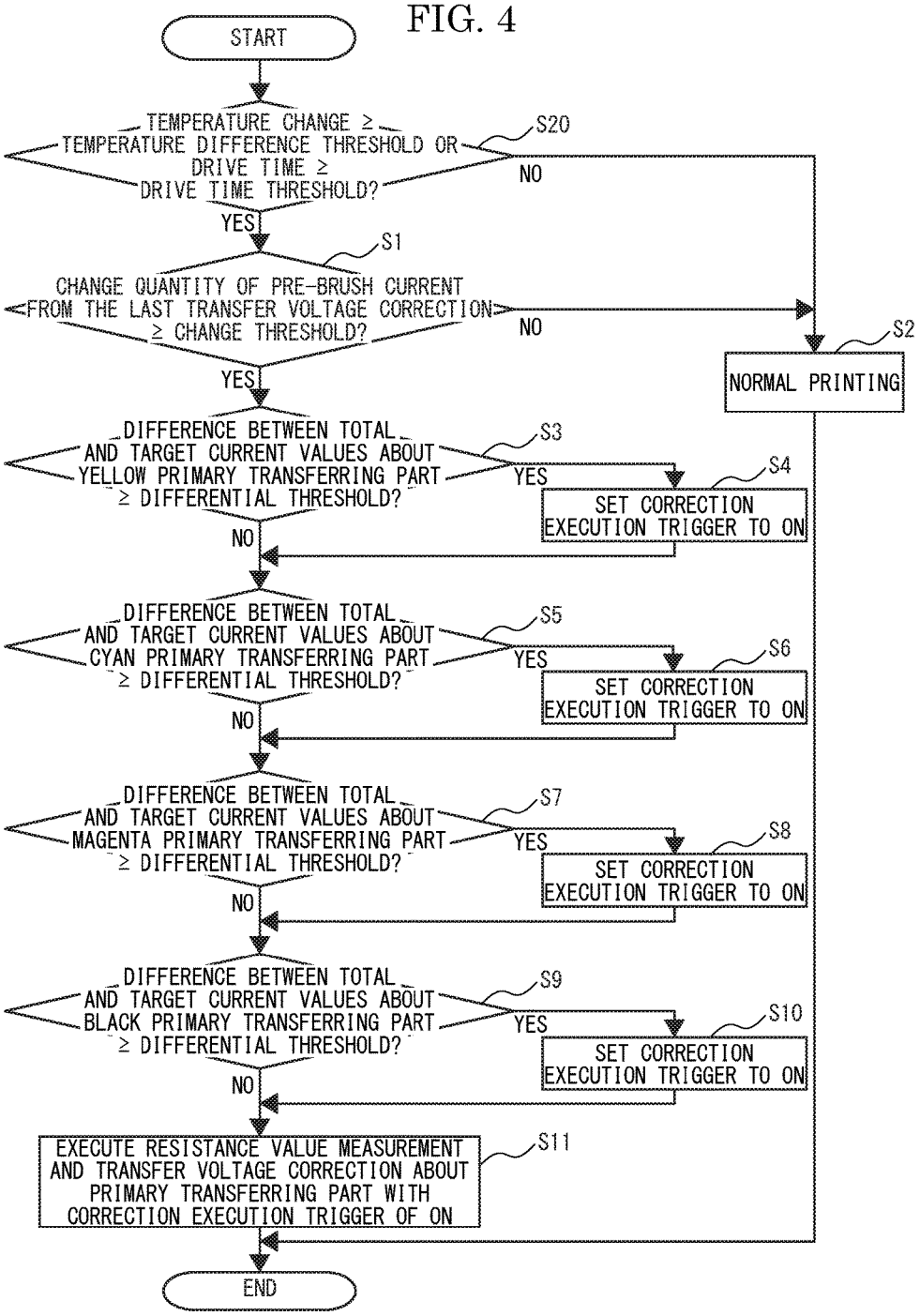
FIG. 4 is a flowchart showing operations of measurement condition decision in the color printer according to another embodiment of the present disclosure, and total current detection, resistance value measurement, and transfer voltage correction of each primary transferring part of the color printer.

In the color printer 1, as a measurement condition for carrying out total current detection by the four transfer voltage applying parts 22 and the total current detecting part 23 with respect to each primary transferring part 8, for example, a case where a change quantity of the pre-brush current flowing through the pre-brush 11 from the last transfer voltage correction by the transfer voltage correcting part 26 to the present time (i.e. a time point of present detection of the pre-brush current) is equal to or more than a predetermined change threshold is defined. The measurement condition is also utilized, as shown in FIGS. 3 and 4, as a measurement condition for carrying out resistance value measurement by the resistance value measuring part 25 and transfer voltage correction by the transfer voltage correcting part 26. Incidentally, decision of the change quantity of a pre-brush current is carried out every time the pre-brush current detecting part 28 detects the pre-brush current. In a case where the transfer voltage correction is not yet carried out even once, such as a case of first detection of the pre-brush current, and the total current detection, the resistance value measurement and the transfer voltage correction may be carried out without deciding the change quantity of the pre-brush current, or alternatively, the resistance value measurement and the transfer voltage correction may be carried out without carrying out the total current detection. The four primary transferring parts 8 become detection subjects for the total current detection at the respectively different timings.

For example, the primary transferring part 8 of the detection subject may be switched every time images are sequentially transferred to the intermediate transferring belt 3 in accordance with a sequential order of disposition of the four primary transferring parts 8, or alternatively, any one of the four primary transferring parts 8 may be specified or selected on the basis of a predetermined condition. A detection timing of the total current detection of the primary transferring part 8 of the detection subject is set to a timing while the primary transferring part 8 of the detection subject is over a space between sheets on the intermediate transferring belt 3 in a series of image forming operations employing the four primary transferring parts 8 (the four image forming parts 4), for example, is set to a timing immediately after transfer of the primary transferring part 8.

The controller 20 consists of a CPU or the like. The controller 20 is connected to the storage 21, the four transfer voltage applying parts 22, the total current detecting part 23, the current voltage comparing part 24, the resistance value measuring part 25, the transfer voltage correcting part 26, the pre-brush voltage applying part 27, the pre-brush current detecting part 28, the measurement condition deciding part 29, the temperature sensing part 30, and other components included in the color printer 1. The controller 20 is configured to be able to control each of these components.

The storage 21 consists of a ROM or a RAM or the like, and stores programs and data required to actualize the image forming process and a variety of other functions of the color printer 1. Incidentally, although FIG. 2 illustrates the current value comparing part 24, the resistance value measuring part 25, the transfer voltage correcting part 26 and the measurement condition deciding part 29 separately from the storage 21, these parts may be configured with the programs stored in the storage 21 and executed by the controller 20.

The four transfer voltage applying parts 22 are provided to be associated with the four primary transferring parts 8, respectively. Each transfer voltage applying part 22 is connected to each primary transferring roller 9 of each primary transferring part 8 to apply a voltage to each primary transferring roller 9. For example, in a case of normal printing, in order to carry out primary transfer by each primary transferring part 8, each transfer voltage applying part 22 applies a transfer voltage to each primary transferring roller 9 in a degree such that a predetermined target transfer current flows through each primary transferring roller 9. The transfer voltage applied by each transfer voltage applying part 22 applies is a voltage value suitable for each primary transferring roller 9 and may be a voltage value different depending on each of the four transfer voltage applying parts 22.

On the other hand, in a case of executing the total current detection with respect to the primary transferring part 8 of the detection subject, the four transfer voltage applying parts 22 apply a first measurement voltage to the primary transferring part 8 of the detection subject and apply a second measurement voltage different from the first measurement voltage to other primary transferring parts 8. For example, the four transfer voltage applying parts 22 apply the transfer voltage (e.g. +1,000 V) as the first measurement voltage to the primary transferring part 8 of the detection subject and apply a zero voltage or a weak voltage (e.g. +50 V) of the same polarity as the transfer voltage as the second measurement voltage to the other primary transferring parts 8 at the detection timing when the primary transferring part 8 of the detection subject is over the space between sheets.

The total current detecting part 23 is connected to the four transfer voltage applying parts 22.

The total current detecting part 23 is a detecting circuit of a current value configured to be common to the four primary transferring rollers 9 (the four primary transferring parts 8) to detect a total current value of the currents flowing through the four primary transferring rollers 9. Incidentally, although the embodiment is described as to an example in which one total current detecting part 23 common to the four primary transferring rollers 9 is provided, the configuration of the total current detecting part 23 is not limited to this example. For example, two total current detecting parts 23 may be provided so that each total current detecting part 23 is connected to each two primary transferring rollers 9 and each current detecting part 23 detects a total current value of the currents flowing through each two primary transferring rollers 9.

For example, in the case of executing the total current detection with respect to the primary transferring part 8 of the detection subject, the total current detecting part 23 detects the total current value of the currents flowing through the four primary transferring rollers 9 (the total current value associated with the primary transferring part 8 of the detection subject) at the detection timing associated with the primary transferring part 8 of the detection subject (the timing of applying the transfer voltage to the primary transferring roller 9 of the detection subject and applying the zero voltage or the weak current to other primary transferring rollers 9).

The current value comparing part 24, with respect to each primary transferring part 8 (each primary transferring roller 9), inputs the total current value detected by the total current detection by the four voltage applying parts 22 and the total current detecting part 23, calculates a current value difference between the total current value and a predetermined target current value and compares the current value difference and a predetermined differential threshold (e.g. the order of 2 μA). If the current value comparing part 24, with respect to the primary transferring part 8 of the detection subject, decides that the current value difference between the total current value and the predetermined target current value is equal to or more than the predetermined differential threshold, the primary transferring part 8 is decided as a correction subject of the transfer voltage. The predetermined target current value of the primary transferring roller 9 (the primary transferring part 8) is determined in advance, for example, at a time of factory shipment or initial setting of the color printer 1. If correction of the transfer voltage is carried out by the transfer voltage correcting part 26, the target current value is updated and set by the total current value detected by the total current detecting part 23 at the time of the correction.

Incidentally, the current value comparing part 24 may store in the storage 21 or the like a correction execution trigger indicating whether or not correction of the transfer voltage is carried out, for each of the four primary transferring parts 8 (the four primary transferring rollers 9). With respect to each primary transferring part 8 (each primary transferring roller 9), the current value comparing part 24 sets the correction execution trigger to OFF in a case of deciding that the current value difference between the total current value and the predetermined target current value is less than the predetermined differential threshold. Alternatively, the current value comparing part 24 sets the correction execution trigger to ON in a case of deciding that the current value difference between the total current value and the predetermined target current value is equal to more than the predetermined differential threshold. After the current value comparing part 24 has set the correction execution trigger with respect to all of the four primary transferring rollers 9, the resistance value measurement and the transfer voltage correction are carried out with respect to the primary transferring roller 9 corresponding to the correction execution trigger of ON.

The resistance value measuring part 25 measures a resistance value of each primary transferring roller 9 (each primary transferring part 8) on the basis of a voltage value applied by each transfer voltage applying part 22, the total current value detected by the total current detecting part 23 and others. For example, the resistance value measuring part 25 executes the resistance value measurement measuring a subject resistance value of the primary transferring roller 9 (the primary transferring part 8) decided as the correction subject of the transfer voltage by the current value comparing part 24 on the basis of the total current value associated with the primary transferring part 8 of the correction subject detected by the total current detection.

Specifically, the resistance value measuring part 25 measures a subject current value (a transfer current) flowing through the primary transferring part 8 (the primary transferring roller 9) of the correction subject, on the basis of the total current value associated with the primary transferring part 8 of the correction subject, while the transfer voltage is applied. In addition, the resistance value measuring part 25 measures the subject resistance value of the primary transferring roller 9 of the correction subject on the basis of the transfer voltage and the subject current value, for example, by dividing the transfer voltage by the subject current value.

The transfer voltage correcting part 26 corrects the transfer voltage applied to each primary transferring roller 9 (each primary transferring part 8) by each transfer voltage applying part 22 to a voltage value in a degree such that the predetermined target transfer current flows. Specifically, the transfer voltage correcting part 26 calculates, with respect to the primary transferring part 8 of the correction subject, the corrected transfer voltage on the basis of the predetermined target transfer current and the subject resistance value, for example, by multiplying the predetermined target transfer current by the subject resistance value. Moreover, the transfer voltage correcting part 26 stores, in a case of carrying out the transfer voltage correction, the pre-brush current detected by the pre-brush current detecting part 28, for subsequent decision of the measurement condition in the storage 21 or the like.

The pre-brush voltage applying part 27 is connected to the pre-brush 11 to apply a cleaning charge voltage of the same polarity as the polarity (e.g. the positive polarity) of the remained toner on the intermediate transferring belt 3 to the pre-brush 11.

The pre-brush detecting part 28 is connected to the pre-brush voltage applying part 27 to detect the pre-brush current flowing through the pre-brush 11 at a predetermined timing. For example, as the predetermined timing, a timing, such as a time point after continuous printing of the order of 300 sheets has been carried out or a time point after the order of 12 hours has elapsed subsequent to use (activation) of the color printer 1, may be set. In other words, as the predetermined timing, a timing when it is considered that a resistance value of the intermediate transferring belt 3 changes by a change of a temperature inside of the printer body 2 and a temperature of the intermediate transferring belt 3 may be set.

The measurement condition deciding part 29 decides in accordance with a predetermined measurement condition whether or not the total current detection by the four transfer voltage applying parts 22 and the total current detecting part 23, the resistance value measurement by the resistance value measuring part 25 and the transfer voltage correction by the transfer voltage correcting part 26 should be carried out. For example, the measurement condition deciding part 29 decides a case where, after the transfer voltage of the primary transferring part 8 is corrected once or more by the transfer voltage correcting part 26, the change quantity of the pre-brush current flowing through the pre-brush 11 detected by the pre-brush current detecting part 28 from the last transfer voltage correction by the transfer voltage correcting part 26 to the present time (i.e. a time point of present detection of the pre-brush current) is equal to or more than the predetermined change threshold (e.g. the order of 100 V), as the measurement condition for executing the total current detection, the resistance value measurement and the transfer voltage correction.

The temperature sensing part 30 senses a temperature in the vicinity of the intermediate transferring belt 3 or the four primary transferring parts 8. Incidentally, although only one temperature sensing part 30 may be provided, temperature sensing parts 30 may be individually provided with respect to the intermediate transferring belt 3 and the respective four primary transferring parts 8.

Next, the image forming operations (a printing operation) of the four image forming parts 4 and operations of the resistance value measurement and the transfer voltage correction of the primary transferring parts 8 in the embodiment will be described with reference to the flowchart of FIG. 3.

Prior to the printing operation of the four image forming parts 4, the cleaning charge voltage (e.g. the positive polarity) is applied to the pre-brush 11 by the pre-brush voltage applying part 27. If the intermediate transferring belt 3 passes through the pre-brush 11, the remained toner on the intermediate transferring belt 3 shifts to the same polarity as the cleaning charge voltage. Moreover, in the cleaning device 10, the collecting roller 13 is electrically charged at the reverse polarity (e.g. the negative polarity) of the remained toner. If the intermediate transferring belt 3 passes through the cleaning device 10, the remained toner on the intermediate transferring belt 3 is caught by the cleaning roller 12 and is efficiently collected by the collecting roller 13 of the reverse polarity of the remained toner.

At this time, by the pre-brush current detecting part 28, the pre-brush current flowing through the pre-brush 11 is detected. Afterwards, in a case where the pre-brush current is equal to or more than the predetermined change threshold (step S1: YES), the total current detection by the four transfer voltage applying parts 22 and the total current detecting part 23 is executed. Incidentally, in a case where the pre-brush current is less than the predetermined change threshold (step S1: NO), normal printing is executed (step S2).

In a case where the total current detection is executed, in the four image forming parts 4, the image forming operation is first carried out at the yellow image forming part 4Y and, at this time, the transfer voltage is applied from the yellow transfer voltage applying part 22Y to the yellow primary transferring roller 9Y (the yellow primary transferring part 8Y), and then, primary transfer of the yellow toner image is carried out with respect to a predetermined printing position on the intermediate transferring belt 3.

When the yellow primary transferring roller 9Y is over the space between sheets after the primary transfer, the detection timing of the total current detection comes. At that time, the total current detection is executed with respect to the yellow primary transferring part 8Y. Specifically, the transfer voltage is applied from the yellow transfer voltage applying part 22Y to the yellow primary transferring roller 9Y and the zero voltage or the weak current is applied from the respective transfer voltage applying parts 22C, 22M and 22K to other primary transferring rollers 9C, 9M and 9K. At this time, the total current value of the four primary transferring rollers 9 is detected by the total current detecting part 23.

Subsequently, by the current value comparing part 24, the current value difference between the total current value associated with the yellow primary transferring part 8Y and the predetermined target current value is compared with the predetermined current threshold (step S3). In a case where the current value difference is less than the predetermined current threshold (step S3: NO), the correction execution trigger of the yellow primary transferring roller 9Y is set to OFF. On the other hand, in a case where the current value difference is equal to or more than the predetermined current threshold (step S3: YES), the yellow primary transferring roller 9Y becomes the correction subject of the transfer voltage and the correction execution trigger of the yellow primary transferring roller 9Y is set to ON (step S4).

Next, the image forming operation is carried out at the cyan image forming part 4C. At this time, the transfer voltage is applied from the cyan transfer voltage applying part 22C to the cyan primary transferring roller 9C (the cyan primary transferring part 8C), and then, primary transfer of the cyan toner image is carried out with respect to the predetermined printing position on the intermediate transferring belt 3.

When the cyan primary transferring roller 9C is over the space between sheets after the primary transfer, the detection timing of the total current detection comes. At that time, the total current detection is executed with respect to the cyan primary transferring part 8C. Specifically, the transfer voltage is applied from the cyan transfer voltage applying part 22C to the cyan primary transferring roller 9C and the zero voltage or the weak voltage is applied from the respective transfer voltage applying parts 22Y, 22M and 22K to other primary transferring rollers 9Y, 9M and 9K. At this time, the total current value of the four primary transferring rollers 9 is detected by the total current detecting part 23.

Subsequently, by the current value comparing part 24, the current value difference between the total current value associated with the cyan primary transferring part 8C and the predetermined target current value is compared with the predetermined current threshold (step S5). In a case where the current value difference is less than the predetermined current threshold (step S5: NO), the correction execution trigger of the cyan primary transferring roller 9C is set to OFF. On the other hand, in a case where the current value difference is equal to or more than the predetermined current threshold (step S5: YES), the cyan primary transferring roller 9C becomes the correction subject of the transfer voltage and the correction execution trigger of the cyan primary transferring roller 9C is set to ON (step S6).

With respect to the magenta image forming part 4M and the black image forming part 4K as well, similarly to the above-described yellow image forming part 4Y and the cyan image forming part 4C, the total current detection (steps S7 to S10) is carried out, and the correction execution trigger of the magenta primary transferring roller 9M and the correction execution trigger of the black primary transferring roller 9K are set.

Next, the resistance value measuring part 25 executes the resistance value measurement with respect to the primary transferring roller 9 of the correction subject of the transfer voltage (corresponding to the correction execution trigger of ON) (step S11) and, on the basis of the total current value according to this primary transferring roller 9, the subject resistance value of this primary transferring roller 9 is measured. In addition, the transfer voltage correcting part 26 executes the transfer voltage correction with respect to the primary transferring roller 9 of the correction subject of the transfer voltage (corresponding to the correction execution trigger of ON) (step S11) and, on the basis of the subject resistance value measured as described above, the transfer voltage applied from the transfer voltage applying part 22 to this primary transferring roller 9 is corrected to a voltage value in a degree such that the predetermined target transfer current flows.

According to the embodiment, as described above, the color printer 1 (the image forming apparatus) includes: the annular intermediate transferring belt 3 (the transferring belt) rotating in the predetermined direction; a plurality of photosensitive drums 7; the plurality of primary transferring parts 8 (the plurality of primary transferring rollers 9); the transfer voltage applying parts 22; the resistance value measuring part 25; the cleaning device 10; the pre-brush 11; the pre-brush current detecting part 28; and the transfer voltage correcting part 26. The photosensitive drums 7 are disposed along the rotation direction of the intermediate transferring belt 3. The primary transferring parts 8 transfer the image formed on the respective photosensitive drums 7 to the intermediate transferring belt 3. The transfer voltage applying parts 22 apply voltages to the respective primary transferring parts 8. The resistance value measuring part 25 measures the subject resistance value of the primary transferring part 8. The cleaning device 10 collects the remained toner on the intermediate transferring belt 3. The pre-brush applies the cleaning charge voltage of the same polarity of the remained toner on the intermediate transferring belt 3 at the upstream side from the cleaning device 10 in the rotation direction of the intermediate transferring belt 3. The pre-brush current detecting part 28 detects the pre-brush current flowing through the pre-brush 11. The transfer voltage correcting part 26 corrects, on the basis of the subject resistance value of the primary transferring part 8 measured by the resistance value measuring part 25, the transfer voltage with respect to the primary transferring part 8. In addition, the case where the change quantity of the pre-brush current detected by the pre-brush current detecting part 28 from the last transfer voltage correction by the transfer voltage correcting part 26 to the present time (i.e. a time point of present detection of the pre-brush current) is equal to or more than the predetermined change threshold is set as the measurement condition. If the measurement condition is satisfied after the transfer voltage of the primary transferring part 8 is corrected regardless of the measurement condition (e.g. at the first time), the resistance value measuring part 25 executes the resistance value measurement measuring the subject resistance value of the primary transferring part 8 and the transfer voltage correcting part 26 executes the transfer voltage correction correcting the transfer voltage of the primary transferring part 8.

Moreover, according to the embodiment, the color printer 1 includes: the total current detecting part 23 to detect the total current value of currents flowing through the plurality of primary transferring parts 8. If the above-described measurement condition is satisfied, the total current detection is executed so that the transfer voltage applying part 22 applies the first measurement voltage to one primary transferring part 8 (the primary transferring part 8 of the detection subject) in the plurality of primary transferring parts 8 and applies the second measurement voltage to other primary transferring parts 8 and the total current detecting part 23 detects the total current value, and the resistance value measuring part 25 executes the resistance value measurement with respect to the one primary transferring part 8 (the primary transferring part 8 of the detection subject) on the basis of the total current value detected by the total current detection, and the transfer voltage correcting part 26 executes the transfer voltage correction with respect to the one primary transferring part 8.

Further, according to the embodiment, the transfer voltage applying part 22 applies, when the total current detection is executed, the transfer voltage, as the first measurement voltage, to the primary transferring part 8 of the detection subject and applies the zero voltage or the weak voltage of the same polarity as the transfer voltage, as the second measurement voltage, to the other primary transferring parts 8. In a case where it is decided that the current value difference between the total current value detected by the total current detection and the predetermined target current value is equal to or more than the predetermined differential threshold, the resistance value measuring part 25 executes the resistance value measurement and the transfer voltage correcting part 26 executes the transfer voltage correction.

By such configurations, since it is decided in accordance with change of the pre-brush current whether or not the resistance value measurement and the transfer voltage correction are carried out, a process time due to the resistance value measurement and the transfer voltage correction can be reduced. For example, if the change quantity of the pre-brush current is equal to or more than the change threshold, since it supports that change of the resistance value of the primary transferring part 8 is great, the resistance value measurement and the transfer voltage correction are carried out. On the other hand, if the change quantity of the pre-brush current is less than the change threshold, since it supports that change of the resistance value of the primary transferring part 8 is small, the resistance value measurement and the transfer voltage correction are not carried out. Thereby, it is possible to favorably maintain productivity of image forming process utilizing the plurality of primary transferring parts without any degradation. Moreover, by deciding change of the pre-brush current, a process time due to the total current detection also can be reduced. By the total current detection, since decision whether or not the resistance value measurement and the transfer voltage correction are carried out is based on the total current value flowed while each primary transferring part 8 is worked, it is possible to reduce a process time for each of the four primary transferring part 8.

Moreover, according to the embodiment, the resistance value measuring part 25 sets, to the predetermined target current value, the total current value detected by the total current detecting part 23 at the time of the last transfer voltage correction by the transfer voltage correcting part 26.

In this manner, it is possible to prevent lowering of a processing speed while reliably avoiding unnecessary correction of the transfer voltage.

Further, according to the embodiment, the transfer voltage correcting part 26 corrects the transfer voltage applied to the primary transferring part 8 of the correction subject by the transfer voltage applying part 22 to the voltage value in a degree such that the predetermined target transfer current flows through the primary transferring part 8 of the correction subject.

In this manner, since the resistance value measured as described above is utilized, the transfer voltage applied to the primary transferring part 8 can be appropriately corrected without any degradation of the productivity of an image forming process. In addition, it is also possible to prevent lowering of a processing speed while avoiding unnecessary correction of the transfer voltage.

Although the above-described embodiment was described as to an example in which the measurement condition deciding part 29 defines, as the measurement condition for executing the total current detection, the resistance value measurement and the transfer voltage correction, the case where the change quantity of the pre-brush current flowing through the pre-brush 11 detected by the pre-brush current detecting part 28 from the last transfer voltage correction by the transfer voltage correcting part 26 to the present time (i.e. a time point of present detection of the pre-brush current) is equal to or more than the predetermined change threshold, the measurement condition is not limited thereto.

For example, in another embodiment, the measurement condition deciding part 29, in addition to the measurement condition described above, may define, as a further measurement condition, for example, a case in which a difference (a temperature change) between the present temperature sensed by the temperature sensing part 30 and the last temperature sensed by the temperature sensing part 30 at the time of the last transfer voltage correction by the transfer voltage correcting part 26 is equal to or more than a predetermined temperature difference threshold (e.g. the order of 5 degrees centigrade). Further, the measurement condition deciding part 29 may define, as a further measurement condition, a case in which a driving time of the intermediate transferring belt 3 and the four primary transferring parts 8 elapsed from the last transfer voltage correction by the transfer voltage correcting part 26 is equal to or more than a predetermined driving time threshold (e.g. the order of one hour). Incidentally, in the case where the driving time has elapsed by the predetermined driving time threshold, the count of the driving time is reset.

A deciding operation of the measurement condition according to such another embodiment will be described with reference to the flowchart of FIG. 4. Incidentally, in the description of the deciding operation, the similar description to the above-described embodiment referenced by the flowchart of FIG. 3 is omitted.

First, by the measurement condition deciding part 29, the temperature change and driving time of the intermediate transferring belt 3 or the four primary transferring parts 8 are decided (step S20). Afterwards, in a case where the temperature change is less than the predetermined temperature difference threshold or in a case where the driving time is less than a predetermined driving time threshold, it is decided by the measurement condition deciding part 29 that the total current detection, the resistance value measurement and the transfer voltage correction are not required (step S20: NO), and the operation is advanced to normal printing (step S2). On the other hand, in a case where the temperature change is equal to or more than the predetermined temperature difference threshold or in a case where the driving time is equal to or more than the predetermined driving time threshold, it is decided by the measurement condition deciding part 29 that the total current detection, the resistance value measurement and the transfer voltage correction should be carried out (step S20: YES).

Then, in the case where it is decided on the basis of the temperature change and the driving time of the intermediate transferring belt 3 and each primary transferring part 8 by the measurement condition deciding part 29 that the total current detection, the resistance value measurement and the transfer voltage correction should be carried out (step S20: YES), further, in the same manner as that in the above-described embodiment, the change quantity of the pre-brush current and the change threshold value are compared with each other (step S1). In a case where the change quantity of the pre-brush current is equal to or more than the change threshold value (step S1: YES), the operation is advanced to the total current detection (step S1). Alternatively, in a case where the change quantity of the pre-brush current is less than the change threshold value (step S1: NO), the operation is advanced to normal printing (step S2).

Subsequently, in the same manner as the above-described embodiment, the total current detection of the primary transferring part 8 of each image forming part 4 (steps S3 to S10) is carried out, and further, the resistance value measurement and the transfer voltage correction are executed with respect to the primary transferring part 8 of the correction subject of the transfer voltage (corresponding to the correction execution trigger of ON) (step S11).

According to such another embodiment, since the measurement condition deciding part 29 decides a temperature change and a change with an elapse of time in a state that degradation of the primary transferring part 8 (the primary transferring roller 9) is concerned, it is possible to prevent lowering of a processing speed while avoiding unnecessary measurement of the resistance value, and it is also possible to more reliably detect a change of the resistance value.

Furthermore, although the above-described embodiment was described as to an example in which the resistance value measurement and the transfer voltage correction are executed with respect to the primary transferring roller 9 corresponding to the correction execution trigger of ON after all of the correction execution triggers of the four primary transferring rollers 9 are set, execution of the resistance value measurement and the transfer voltage correction is not limited thereto. For example, in still another embodiment, the resistance value measurement and the transfer voltage correction may be executed, without setting any correction execution trigger, immediately at a time point when the current value comparing part 24 decides at the time of the total current detection of each primary transferring roller 9 that the transfer voltage should be corrected.

Although the above-described embodiment was described as to an example in which, in the total current detection, the four transfer voltage applying parts 22 apply the transfer voltage (e.g. +1,000 V), as the first measurement voltage, to the primary transferring part 8 of the detection subject and apply the zero voltage and the weak voltage (e.g. +50 V) of the same polarity as the transfer voltage, as the second measurement voltage, to other primary transferring parts 8, a technique of the total current detection is not limited thereto. For example, in still another embodiment, in the total current detection, it may be that the four transfer voltage applying parts 22 apply the zero voltage or the weak voltage of the same polarity as the transfer voltage, as the first measurement voltage, to the primary transferring part 8 of the detection subject, and apply the transfer voltage, as the second measurement voltage, to the other primary transferring parts 8.

Incidentally, in this case, the total current detecting part 23 detects the first total current value in a case where the zero voltage or the weak current is applied to the primary transferring part 8 of the detection subject. Moreover, the total current detecting part 23 detects in advance a second total current value in a case where the transfer voltage is applied to all of the primary transferring parts 8. Afterwards, in a case where the primary transferring part 8 of the detection subject becomes the correction subject of the transfer voltage, the resistance value measuring part 25 measures the subject current value (the transfer current) flowing through the primary transferring part 8 of the correction subject, on the basis of a current difference between the first total current value and the second total current value. In addition, the resistance value measuring part 25 measures the subject resistance value of the primary transferring part 8 of the correction subject, on the basis of the transfer voltage and the subject current value, for example, by dividing the transfer voltage by the subject current value. Incidentally, the technique of the transfer voltage correction by the transfer voltage correcting part 26 may be similar to that described above.

In this manner, since the resistance value can be measured in a state that the zero voltage or the weak voltage is applied to the primary transferring part 8 of the detection subject, it is possible to utilize a measurement timing when the primary transferring part 8 of the detection subject is over a small space between sheets. According to this, it is unnecessary to provide time for the resistance value measurement of the primary transferring part 8 and it is possible to favorably maintain productivity of image forming process utilizing the plurality of primary transferring parts without any degradation.

Although the above-described embodiment was described as to a configuration deciding on the basis of the result of the total current detection whether or not the resistance value measurement and the transfer voltage correction are carried out, in order to reduce a process time of the resistance value measurement and the transfer voltage correction, the present disclosure is not restricted by this configuration. For example, in a further embodiment, the color printer 1 may be configured so as to infer a change of the resistance value of each primary transferring part 8 on the basis of a change of the pre-brush current without carrying out the total current detection.

In this case, the pre-brush 11 is made of a material having electronic conductivity and produced so as to have a resistance rate ρ equal to the primary transferring roller 9 (the primary transferring part 8). Incidentally, the resistance rate ρ of the pre-brush 11 may be set to a value equal to a resistance rate of any one primary transferring roller 9 in the four primary transferring rollers 9 or a value equal to an averaged resistance rate of the four primary transferring rollers 9. A difference between the resistance rate ρ of the pre-brush 11 and the resistance rate of the primary transferring roller 9 is set, for example, to a value less than 0.5 Log Ω.

Figure 5:
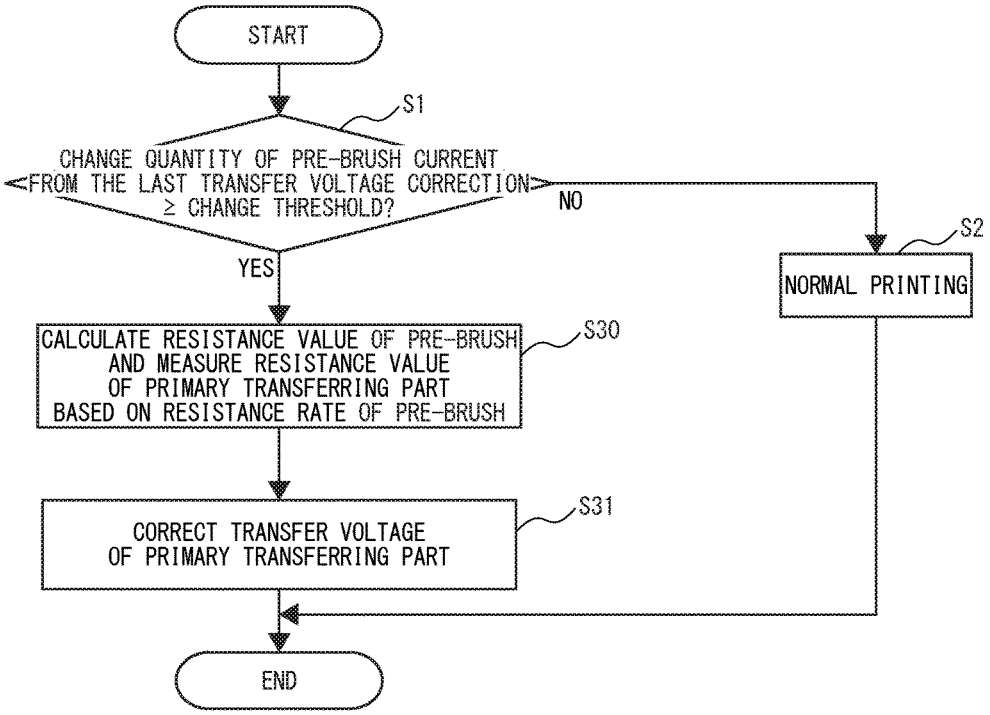
FIG. 5 is a flowchart showing operations of measurement condition decision in the color printer according to a further embodiment of the present disclosure, and total current detection, resistance value measurement, and transfer voltage correction of each primary transferring part of the color printer.

In such a further embodiment, as shown in FIG. 5, the resistance value measuring part 25 defines, similarly to the above-described embodiment, as the measurement condition, a case where the change quantity of the pre-brush current flowing through the pre-brush 11 from the last transfer voltage correction by the transfer voltage correcting part 26 to the present time is equal to or more than the predetermined change threshold (step S1).

Subsequently, if this measurement condition is satisfied (step S1: YES), on the basis of the cleaning charge voltage applied by the pre-brush voltage applying part 27 and the pre-brush current detected by the pre-brush current detecting part 28, the resistance value of the pre-brush 11 is calculated (step S30). Moreover, the resistance value measuring part 25 calculates the resistance rate ρ of the pre-brush 11 on the basis of the calculated resistance value of the pre-brush 11. If the pre-brush current is changed, it is inferred that the resistance rate ρ of the pre-brush 11 is changed. Further, the resistance value measuring part 25 calculates the subject resistance value of the primary transferring roller 9 (the primary transferring part 8) on the basis of the calculated resistance rate ρ of the pre-brush 11.

Because the primary transferring roller 9 has the resistance rate equal to the pre-brush 11, if the resistance rate ρ of the pre-brush 11 is changed, it is inferred that the resistance rate of the primary transferring roller 9 is changed similarly. Therefore, if the primary transferring roller 9 has a cross-sectional area S along a circumferential direction and a length L in the circumferential direction, the subject resistance value of the primary transferring roller 9 is calculated by a mathematical formula of ρ*L/S using the resistance rate ρ of the pre-brush 11. Such a calculation of the subject resistance value on the basis of the resistance rate ρ of the pre-brush 11 is carried out for each of the four primary transferring rollers 9.

Afterwards, the transfer voltage correcting part 26 executes the transfer voltage correction with respect to the respective four primary transferring rollers 9 similarly to the above-described embodiment (step S31). In this transfer voltage correction, on the basis of the subject resistance value calculated on the basis of the resistance rate ρ of the pre-brush 11, the transfer voltages applied to the primary transferring rollers 9 by the transfer voltage applying parts 22 are corrected to a voltage in a degree such that the predetermined target transfer current flows through.

According to such a further embodiment, since the subject resistance value of the primary transferring roller 9 is measured on the basis of the resistance rate ρ of the pre-brush 11, it is possible to carry out the resistance value measurement at a timing requiring the transfer voltage correction without affecting printing operation. Moreover, it is possible to omit processes applying a voltage and detecting a current for each of the four primary transferring rollers 9 in order to carry out the resistance value measurement. Therefore, it is possible to reduce a process time of the resistance value measurement and the transfer voltage correction. Incidentally, since the total current detecting part 23 and the current value comparing part 24 may be omitted, it is possible to simplify a configuration of the color printer 1.

Figure 6:
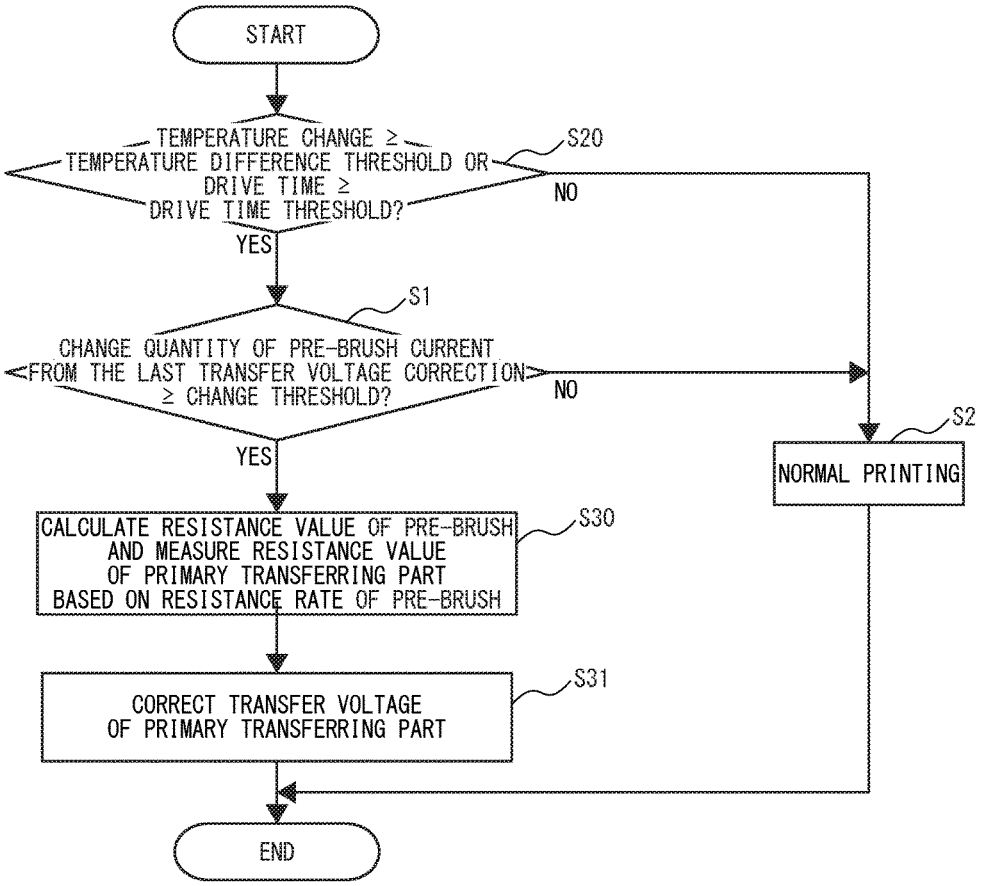
FIG. 6 is a flowchart showing operations of measurement condition decision in the color printer according to a further embodiment of the present disclosure, and total current detection, resistance value measurement, and transfer voltage correction of each primary transferring part of the color printer.

In addition, in such a further embodiment, as shown in FIG. 6, the measurement condition deciding part 29 may define, in addition to the measurement condition of change of the pre-brush current, as a measurement condition, the temperature change and the drive time of the intermediate transferring belt 3 and each primary transferring part 8 (step S20).

That is, the measurement condition deciding part 29 decides the temperature change and the drive time of the intermediate transferring belt 3 and each primary transferring part 8. In the case where the temperature change is less than the predetermined temperature difference threshold or in the case where the driving time is less than a predetermined driving time threshold, the measurement condition deciding part 29 decides that the resistance value measurement and the transfer voltage correction are not required (step S20: NO) and the operation is advanced to normal printing (step S2). On the other hand, in the case where the temperature change is equal to or more than the predetermined temperature difference threshold or in the case where the driving time is equal to or more than the predetermined driving time threshold, the measurement condition deciding part 29 decides that the resistance value measurement and the transfer voltage correction should be carried out (step S20: YES). The resistance value measurement (step S30) and the transfer voltage correction (step S31) are carried out similarly to the above-description.

Although the embodiments was described about a case applying the configuration of the present disclosure to the color printer 1, in another different embodiment, the configuration of the present disclosure may be applied to another image forming apparatus including the plurality of photosensitive drums, such as a copying machine, a facsimile and a multifunction peripheral.

Further, the above-description of the embodiments was described about one example of the image forming apparatus including this. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. An image forming apparatus comprising:

an annular transferring belt rotating in a predetermined direction;

a plurality of photosensitive drums disposed along a rotation direction of the transferring belt;

a plurality of primary transferring parts transferring images respectively formed on the plurality of photosensitive drums to the transferring belt;

a transfer voltage applying part applying respective voltages to the plurality of primary transferring parts;

a resistance value measuring part measuring a subject resistance value of the primary transferring part;

a cleaning device collecting a remained toner on the transferring belt;

a pre-brush applying a cleaning charge voltage of the same polarity as the remained toner to the remained toner on the transferring belt at an upstream side from the cleaning device in the rotation direction of the transferring belt;

a pre-brush current detecting part detecting a pre-brush current flowing through the pre-brush; and a transfer voltage correcting part, on the basis of a subject resistance value of the primary transferring part measured by the resistance value measuring part, correcting a transfer voltage with respect to the primary transferring part, wherein, a case where a change quantity of the pre-brush current detected by the pre-brush current detecting part from the last transfer voltage correction by the transfer voltage correcting part is equal to or more than a predetermined change threshold is defined as a measurement condition, if the measurement condition is satisfied, the resistance value measuring part executes resistance value measurement measuring the subject resistance value of the primary transferring part and the transfer voltage correcting part executes the transfer voltage correction correcting the transfer voltage of the primary transferring part.

2. The image forming apparatus according to claim 1 further comprising:

a total current detecting part detecting a total current value of currents flowing through the plurality of primary transferring parts, wherein if the measurement condition is satisfied, total current detection is executed so that the transfer voltage applying part applies a first measurement voltage to one primary transferring part in the plurality of primary transferring parts and applies a second measurement voltage to other primary transferring parts and the total current detecting part detects the total current value, and the resistance value measuring part executes the resistance value measurement with respect to the one primary transferring part on the basis of the total current value detected by the total current detection, and the transfer voltage correcting part executes the transfer voltage correction with respect to the one primary transferring part.

3. The image forming apparatus according to claim 2, wherein the transfer voltage applying part, when the total current detection is executed, applies the transfer voltage as the first measurement voltage to the one primary transferring part and applies a zero voltage or a weak voltage of the same polarity as the transfer voltage, as the second measurement voltage, to the other primary transferring parts, in a case where a current value difference between the total current value detected by the total current detection and a predetermined target current value is defined to be equal to or more than a predetermined differential threshold, the resistance value measuring part executes the resistance value measurement and the transfer voltage correcting part executes the transfer voltage correction.

4. The image forming apparatus according to claim 3, wherein the resistance value measuring part sets, to the predetermined target current value, the total current value detected by the total current detecting part at the time of the last transfer voltage correction by the transfer voltage correcting part.

5. The image forming apparatus according to claim 2, wherein the transfer voltage applying part, when the total current detection is executed, at a detection timing when the one primary transferring part is over a space between sheets, applies a zero voltage or a weak voltage of the same polarity as the transfer voltage, as the first measurement voltage, to the one transferring part and applies the transfer voltage as the second measurement voltage to the other primary transferring parts.

6. The image forming apparatus according to claim 2, wherein the one primary transferring part is switched every time images are sequentially transferred to the transferring belt in accordance with a sequential order of disposition of the plurality of primary transferring parts.

7. The image forming apparatus according to claim 2, wherein a correction execution trigger indicating whether or not correction of the transfer voltage is carried out is stored for each of the primary transferring parts.

8. The image forming apparatus according to claim 1, wherein the pre-brush is made to have a resistance rate equal to at least one primary transferring part in the plurality of primary transferring parts, the resistance value measuring part calculates a resistance value of the pre-brush on the basis of the cleaning charge voltage of the pre-brush and the pre-brush current, calculates the resistance rate of the pre-brush on the basis of the calculated resistance value of the pre-brush, and calculates the subject resistance values of the plurality of primary transferring parts on the basis of the calculated resistance rate of the pre-brush.

9. The image forming apparatus according to claim 1, wherein the transfer voltage correcting part corrects the transfer voltage applied to the primary transferring part by the transfer voltage applying part, to a voltage value in a degree such that a predetermined target transfer current flows through the primary transferring part.

10. The image forming apparatus according to claim 1 further comprising:

a temperature sensing part sensing a temperature in a vicinity of the transferring belt and the plurality of primary transferring parts, wherein, in addition to the measurement condition, a case where a difference between the present temperature sensed by the temperature sensing part and the last temperature sensed by the temperature sensing part at the time of the last transfer voltage correction by the transfer voltage correcting part is equal to or more than a predetermined temperature difference threshold is set as a further measurement condition.

11. The image forming apparatus according to claim 1, wherein in addition to the measurement condition, a case where a driving time of the transferring belt and the plurality of primary transferring parts elapsed from the last transfer voltage correction by the transfer voltage correcting part by the transfer voltage correcting part is equal to or more than a predetermined driving time threshold.

12. The image forming apparatus according to claim 1, wherein the pre-brush current detecting part detects the pre-brush current at a timing when a temperature of the transferring belt changes and a resistance value of the transferring belt changes.

* * * * *